US006341698B1

(12) United States Patent
Wursthorn

(10) Patent No.: US 6,341,698 B1
(45) Date of Patent: Jan. 29, 2002

(54) SHEET STACKING DEVICE

(75) Inventor: Hermann Wursthorn, Eichstetten (DE)

(73) Assignee: Ga-Tek Inc., Eastlake, OH (US)

( * ) Notice: Subject to any disclaimer, the term of this patent is extended or adjusted under 35 U.S.C. 154(b) by 0 days.

(21) Appl. No.: 09/530,991

(22) PCT Filed: Mar. 9, 1999

(86) PCT No.: PCT/US99/20101

§ 371 Date: May 8, 2000

§ 102(e) Date: May 8, 2000

(87) PCT Pub. No.: WO01/17697

PCT Pub. Date: Mar. 15, 2001

(51) Int. Cl.[7] ..... B07C 5/00

(52) U.S. Cl. ..... 209/552; 271/275; 271/198; 271/202; 271/300; 271/302; 414/793.5; 414/794.8

(58) Field of Search ..... 414/793.4, 793.5, 414/794.4, 794.8; 209/552, 571, 687, 707; 271/275, 198, 202, 288, 300, 302, 218

(56) References Cited

U.S. PATENT DOCUMENTS

| | | | | |
|---|---|---|---|---|
| 726,161 A | | 4/1903 | Harris | |
| 2,323,174 A | | 6/1943 | Wikle | |
| 2,325,919 A | | 8/1943 | Porch | 198/65 |
| 2,575,426 A | | 11/1951 | Parnell | 99/154 |
| 3,346,128 A | | 10/1967 | Hullhorst | 214/6 |
| 3,685,636 A | | 8/1972 | Putin | 198/127 |
| 3,768,807 A | | 10/1973 | Spengler | 271/190 |
| 3,807,553 A | * | 4/1974 | Billett et al. | 414/793.5 |
| 3,894,638 A | | 7/1975 | Hovekamp | 214/6 DK |
| 4,055,257 A | * | 10/1977 | Krebs | 414/793.5 |
| 4,159,108 A | * | 6/1979 | Haft | 414/793.5 |
| 4,856,263 A | * | 8/1989 | Schneider et al. | 414/794.8 |
| 5,360,100 A | | 11/1994 | Bourgeois | 198/790 |

FOREIGN PATENT DOCUMENTS

| | | | | |
|---|---|---|---|---|
| JP | 0044457 | * | 3/1985 | 271/198 |

* cited by examiner

*Primary Examiner*—H. Grant Skaggs
(74) *Attorney, Agent, or Firm*—Mark Kusner; Michael A. Centanni

(57) ABSTRACT

A sheet stacking device comprised of a sheet support bed having a first end and a second end. The sheet support bed is comprised of a plurality of side-by-side rollers, each of the rollers being freely rotatable about an associated roller axis. A drive assembly moves the sheet support bed in a predetermined direction along a closed path, the path having a horizontal upper run and a horizontal lower run, and is dimensioned such that a space exists between the first end and the second end of the sheet support bed as the sheet support bed moves along the path. A roller control assembly for selectively and sequentially controlling rotation of select ones of the rollers at select intervals during a stacking operation.

19 Claims, 12 Drawing Sheets

SHEET STACKING DEVICE

FIELD OF THE INVENTION

The present invention relates to a stacking device, and more particularly, to a stacking device for stacking sheet material. The present invention is particularly applicable in stacking cut-to-length sheets from a generally continuous source, and shall be described with particular reference thereto. It will, of course, be appreciated that the present invention has other broader applications and may be used in stacking other types of sheet material.

BACKGROUND OF THE INVENTION

Many types of sheet material are produced by a process wherein individual sheets are cut from a generally continuous strip or web of material. It is then necessary to stack these "cut-to-length sheets" for packaging and/or shipping. In the process of stacking and/or shipping these "cut-to-length sheets", it is often desirable to minimize the contact between the sheets and the stacking device so as not to damage the sheets.

The present invention provides a device for stacking sheet material, such as cut-to-length sheets that are cut from a generally continuous source, that minimizes physical handling and gripping of the sheet.

SUMMARY OF THE INVENTION

In accordance with the present invention, there is provided a sheet stacking device, comprised of a sheet support bed comprised of a plurality of side-by-side rollers. Each of the rollers is freely rotatable about a respective roller axis. A support bed drive assembly is provided for moving the sheet support bed in a predetermined direction along a closed path. The path has an upper horizontal run and a lower horizontal ran and is dimensioned such that a gap exists between a leading end and a trailing end of the sheet support bed. The gap moves along the path as the sheet support bed moves along the path. A roller control assembly is provided for selectively controlling rotation of each of the rollers about its respective roller axis. A controller selectively and sequentially controls the operation of the support bed drive assembly and the roller drive assembly. The stacking device is operable to perform the following operational steps:

a) causing the support bed drive assembly to move the sheet support bed to a sheet receiving position on the upper run of the path;

b) causing the roller control assembly to allow the rollers to rotate freely to receive a sheet to be stacked on the support bed;

c) causing the support bed drive assembly to move the sheet support bed at a predetermined speed along the path to move the sheet to a "stacking position";

d) when the sheet is at the stacking position, causing the roller control assembly to rotate the roller in a predetermined direction at a predetermined speed while the support bed continues to move along the path, wherein the rollers are operable to convey the sheet in a direction opposite the direction of the support bed at a speed wherein the sheet remains essentially stationary at the "stacking position";

e) continuously driving the sheet support bed along the path and continuously rotating the roller wherein the sheet becomes unsupported as the trailing end of the sheet support bed passes under the sheet and the sheet drops through the gap onto the sheet support bed as it moves along the lower run;

f) causing the rollers along the lower run to rotate at a predetermined speed in a predetermined direction wherein the sheet is conveyed in a direction opposite the direction of the support bed at a speed wherein the sheet remains essentially stationary at a position essentially below the stacking position; and g) continuously driving the sheet support bed along the path and continuously rotating the roller along the lower run wherein the sheet becomes unsupported as the trailing end of the sheet support bed passes under the sheet and the sheet drops through the gap onto a stacking platform.

In accordance with another aspect of the present invention, there is provided a sheet stacking device, comprised of a sheet support bed having a first end and a second end. The sheet support bed is comprised of a plurality of side-by-side rollers, each of the rollers being freely rotatable about an associated roller axis. A drive assembly moves the sheet support bed in a predetermined direction along a closed path, the path having a horizontal upper run and a horizontal lower run, and is dimensioned such that a space exists between the first end and the second end of the sheet support bed as the sheet support bed moves along the path. A roller control assembly selectively and sequentially controls rotation of select ones of the rollers at select intervals during a stacking operation, wherein the stacking device is operable to:

receive a sheet to be stacked on the sheet support bed when the support bed is disposed along the upper run;

convey the sheet along the upper run on the support bed to a "staking position" on the upper run;

cause the roller control assembly to rotate rollers disposed along the upper run in a direction such that the sheet remains essentially in the stacking position as the sheet support bed continues to move along the path, the sheet dropping through the space between the first and the second end of the sheet support bed onto the rollers of the sheet support bed on the lower run when the support bed moves from the upper run to the lower run; and cause the roller control assembly to rotate rollers disposed along the lower run in a direction such that the sheet remains essentially in the stacking position as the sheet support bed continues to move along the path, the sheet dropping through the space between the first end and the second end of the sheet support bed onto a stack of sheets when the support bed moves from the lower run to the upper run.

In accordance with another aspect of the present invention, there is provided a method of stacking sheet material, comprising the steps of:

a) conveying a sheet to be stacked onto the surface of a sheet support bed, the support bed comprised of a plurality of side-by-side rollers, each of the rollers being rotatable about a respective roller axis, the support bed being movable in a predetermined direction along a closed path having a horizontal upper run and a horizontal lower run, the path dimensioned such that a space exists between distal ends of the support bed, the space moving along the path as the support bed moves along the path;

b) moving the support bed along the path to move the sheet along the upper path run toward a stacking position;

c) causing the rollers along the upper run to rotate when the sheet reaches the stacking position, the roller rotating in a direction such that the sheet remains essentially stationary on the support bed at the stacking position as the support bed continues to move along the path, the sheet falling generally vertically onto the support bed on the lower run when the space moves under the sheet;

d) causing the rollers along the lower run to rotate in a direction such that the sheet falling on the support bed from the upper run remains essentially stationary on the support as the support bed continues to move along the path, the sheet falling from the lower run of the support bed when the space moves under the sheet; and e) collecting the sheet at a stacking location below the lower run.

It is an object of the present invention to provide a stacking device for stacking sheet material.

It is another object of the present invention to provide a stacking device for stacking "cut-to-length sheets" from a generally continuous source of sheet material.

It is another object of the present invention to provide a device as described above having means for detecting defects on a cut-to-length sheet.

It is a still further object of the present invention to provide a stacking device as described above that diverts cut-to-length sheets with defects from the stacking operation.

It is a still further object of the present invention to provide a stacking device that minimizes contact with the sheet material to be stacked.

These and other objects and advantages will become apparent from the following description of a preferred embodiments of the invention taken together with the accompanying drawings.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF PREFERRED EMBODIMENT

Figure 1:
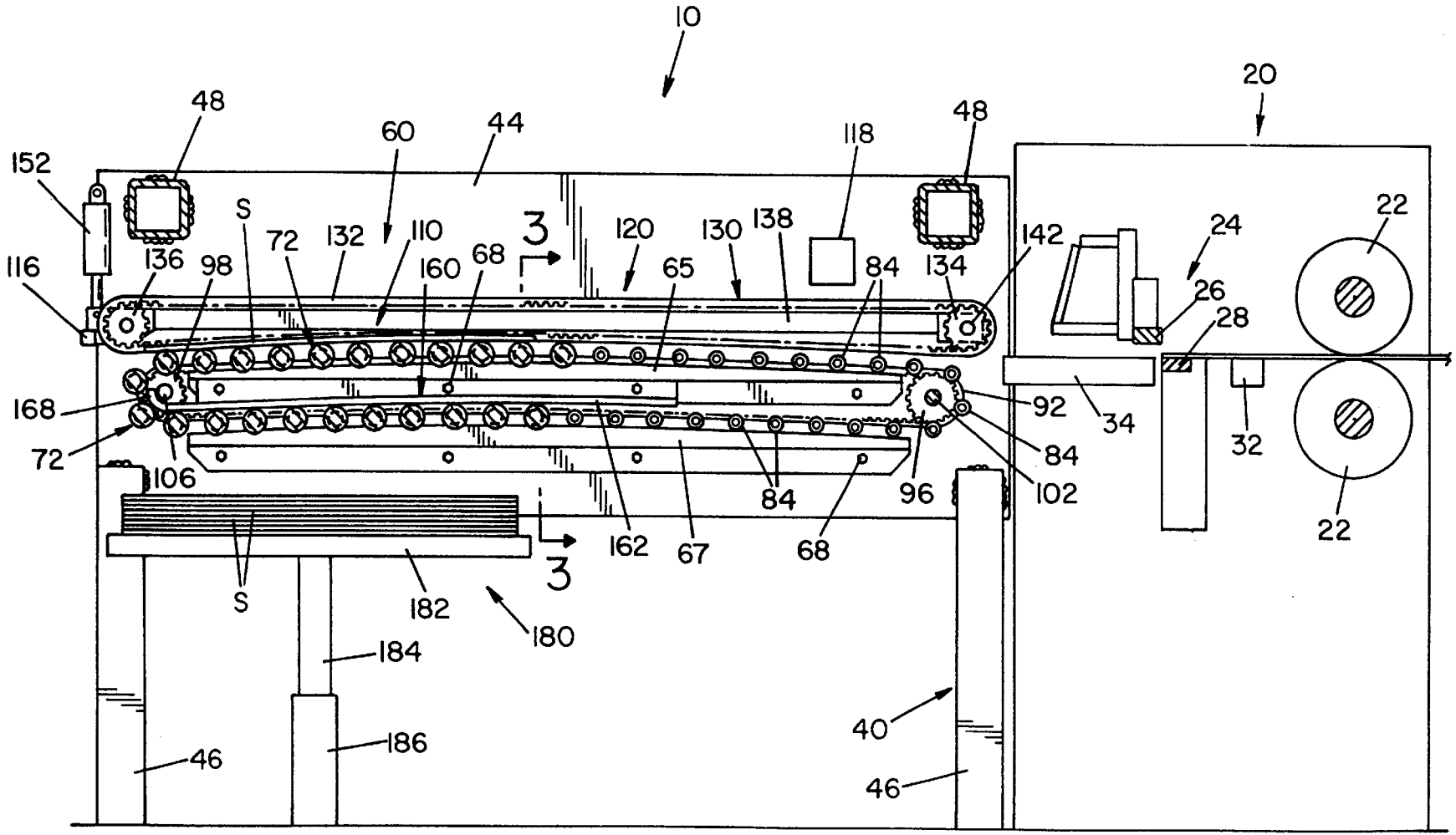
FIG. 1 is a partially sectioned, side elevational view of a sheet-stacking device, illustrating a preferred embodiment of the present invention.
Figure 2:
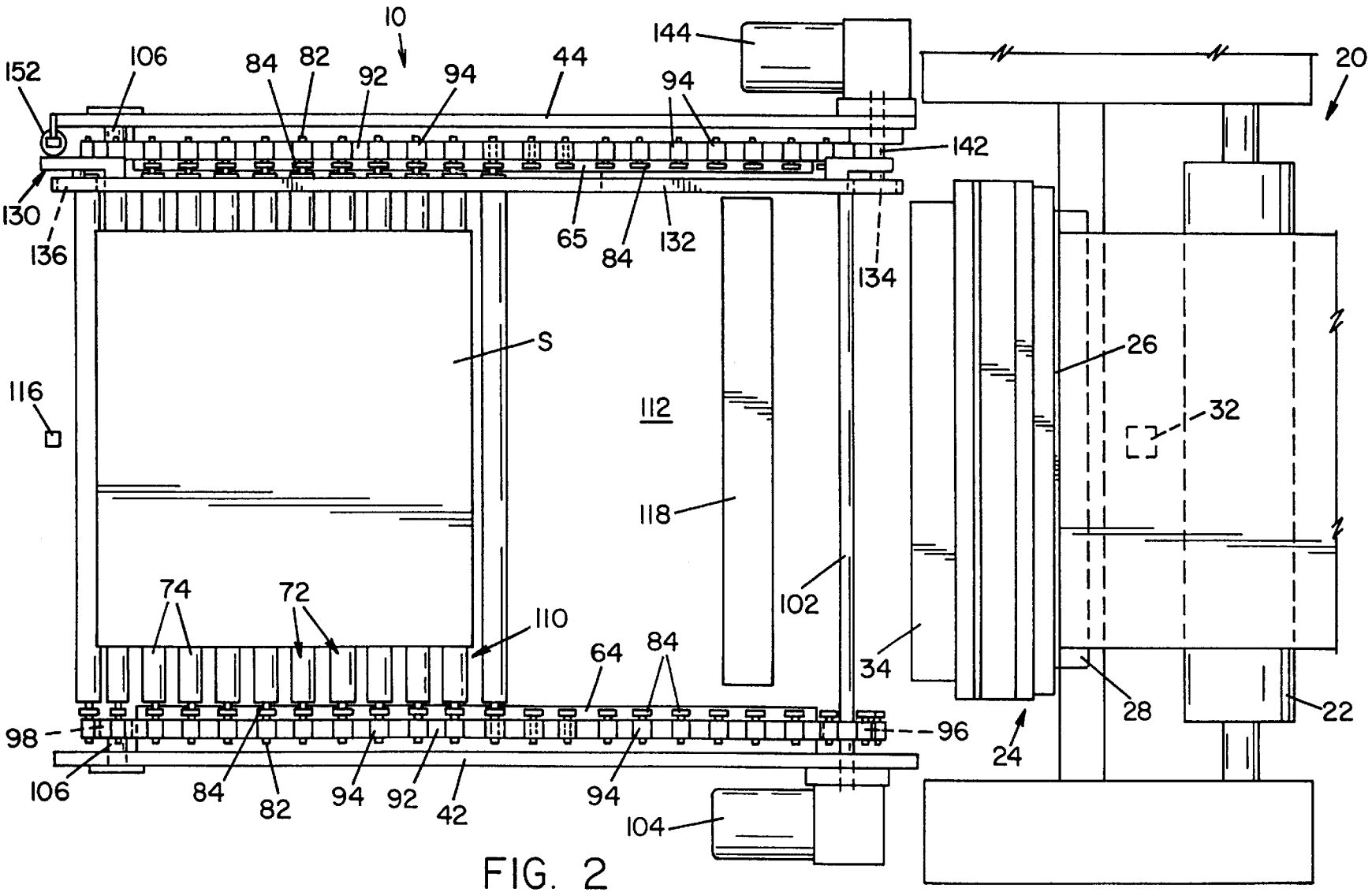
FIG. 2 is a top plan view of the sheet stacking device shown in FIG. 1.
Figure 3:
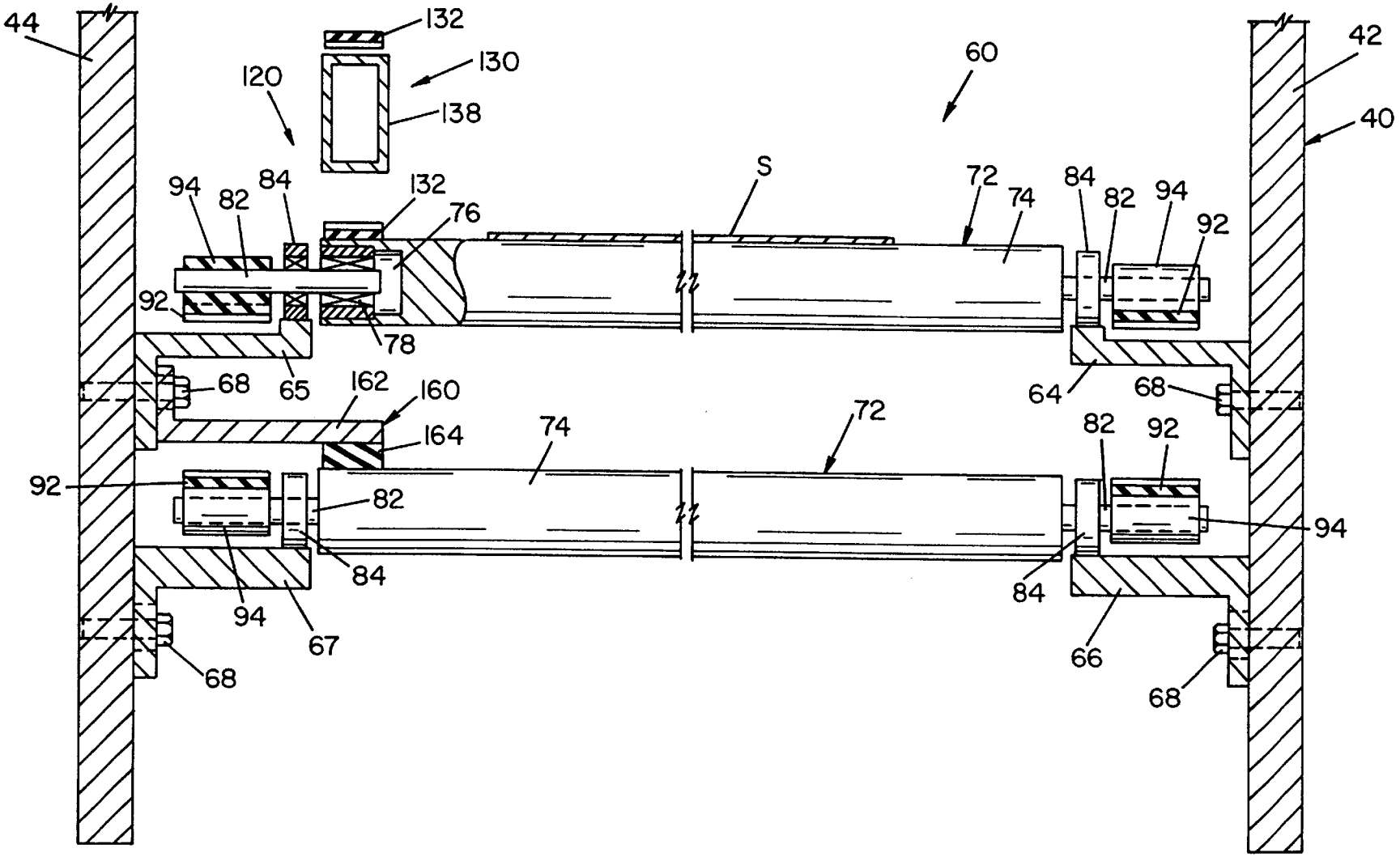
FIG. 3 is a sectional view taken along lines 3—3 of FIG. 1.

Referring now to the drawings wherein the showings are for the purpose of illustrating a preferred embodiment of the invention only, and not for the purpose of limiting same, FIGS. 1–3 show a sheet stacking device 10 illustrating a preferred embodiment of the present invention. Sheet stacking device 10 is adapted to receive individual sheets, designated S, of a planar material at a first position relative thereto, and to stack such sheets S into a vertical stack at a second position.

In the drawings, sheet stacking device 10 is shown together with a sheet cutting device 20 that is operable to cut to length sheets S from a generally continuous length of material (not shown). Sheet cutting device 20 in and of itself forms no part of the present invention, and is shown solely for the purpose of illustration. Sheet cutting device 20 merely represents a source of "cut-to-length sheets" S to be stacked. It will be appreciated from a further reading of the specification that sheets S need not be cut from continuous roll, but may be formed in a flat planar configuration by any suitable process.

In the particular embodiment shown, the material to be cut into sheets S is guided along a predetermined path by guide rollers 22. A cutting assembly 24 is provided along the path to cut the sheet material into sheets S of predetermined lengths. FIG. 1 shows a cutting assembly 24 comprised of a movable upper cutting die 26 and a stationary lower cutting die 28. Supports 32, 34 on opposite sides of cutting assembly 24 support the material relative to cutting dies 26, 28. Cutting assembly 24 is operable to repeatedly shear like sized sheets S from the roll material and to provide individual sheets S to stacking device 10 at the aforementioned first position.

Sheet stacking device 10 is disposed adjacent to the supply path at a predetermined elevation relative thereto to receive sheets S from sheet cutting device 20. Broadly stated, sheet stacking device 10 is comprised of a frame assembly 40, a sheet transport assembly 60, a roller control assembly 120 and a stacking assembly 180.

Frame Assembly

Frame assembly 40 is comprised of two spaced-apart plates 42, 44 that are vertically oriented and parallel to each other. Plates 42, 44 define the side walls of sheet stacking device 10 and are supported by vertical legs 46, as best seen in FIG. 1. Transverse beams 48 connect plates 42, 44 to each other and define a predetermined spacing therebetween. In the embodiment shown, legs 46 and beams 48 are formed of rectangular pipe.

Sheet Transport Assembly

Sheet transport assembly 60 is disposed between plates 42, 44. Sheet transport assembly 60 is basically comprised of a plurality of rollers 72 that are movable along an endless path. The path of rollers 72 is generally defined by a pair of elongated, upper tracks, designated 64 and 65, and a pair of elongated lower tracks 66 and 67, that are best seen in FIG. 3. Upper tracks 64 and 65 are mirror images of each other, and lower tracks 66 and 67 are also mirror images of each other. Lower tracks 66 and 67 are attached to side plates 42, 44, respectively such that the upper surfaces thereof are in horizontal alignment with each other, as seen in FIG. 3. Likewise, upper tracks 64 and 65 are attached to side plate 42, 44 such that the upper surfaces thereof are in horizontal alignment. Tracks 64, 65, 66 and 67 are attached to side plates 42, 44 by conventional fasteners 68. In the embodiment shown, the upper surfaces of upper tracks 64 and 65 and lower tracks 66 and 67 are slightly convex from one end to the other, as best seen in FIG. 1. As will be appreciated from a further reading of the specification, the upper surfaces of tracks 64, 65, 66 and 67 need not be slightly convex to practice the present invention. These surfaces may be flat. In the particular embodiment shown, the upper surface of upper tracks 64, 65 are slightly convex for better contact with flexible belt 132 that is described in greater detail below. In the embodiment shown, the upper surfaces of lower tracks 66 and 67 are slightly convex to provide greater contact with rail 162 that is described in greater detail below. Upper tracks 64 and 65 define an "upper run" for rollers 72, while lower tracks 66 and 67 define a "lower run" for roller 72.

Referring now to FIG. 3, the construction of each roller 72 is best seen. Each roller 72 is comprised of a roller body 74 that is generally cylindrical in shape. Bores 76 are formed in each end of roller body 74. Bores 76 are dimensioned to receive a roller bearing 78 therein. A shaft 82 is mounted within each roller bearing 78 and extends axially outward from the ends of roller body 74. Each shaft 82 has a track bearing 84 mounted thereon. Track bearing 84 is disposed on shaft 82 to rest upon the respective surfaces of upper and lower tracks 64, 65, 66 and 67.

The free ends of shafts 82 extend into hubs 94 formed on conveyor belts 92. In the embodiment shown, conveyor belts 92 are endless loops, having hubs 94 integrally formed thereon. Conveyor belts 92 are preferably formed of a flexible polymer material, such as nylon. A conveyor belt 92 is provided at each end of roller 72. Each conveyor belt 92 extends around a drive sprocket 96 and an idler sprocket 98. The inner surface of conveyor belt 92 includes splines adapted to interact with teeth on drive sprockets 96 and idler sprockets 98. Drive sprockets 96 are mounted onto a drive shaft 102 for simultaneous rotation by a drive motor 104. Drive motor 104 is fixedly mounted onto side plate 42. Idler shafts 106 connect idler sprockets 98 to the frame 40. Drive motor 104 is preferably a stepping motor having control means (not shown) to control movement of conveyor belts 92 and rollers 72 in a predetermined sequence as shall be described in greater detail below.

As shown in FIGS. 1 and 2, a little more than one-half of hubs 94 of conveyor 92 have rollers 72 mounted therein. As best seen in FIGS. 1 and 2, rollers 72 are mounted onto conveyor 92 to form a generally continuous roller bed 110 (i.e., a support bed comprised of adjacent rollers 72) and a gap or space 112 separating the distal ends of roller bed 110.

A sensor 116 is located at the end of the "upper run" of belt 92, as best seen in FIGS. 1 and 2. Sensor 116 is positioned to sense the edge of a sheet S moving along the upper run of the path of rollers 72, as shall be described in greater detail below.

A scanner 118 is mounted to frame assembly 40 and extends parallel to the axes of rollers 72. Scanner 118 is disposed above belt 92 and is disposed to be able to scan sheets moving along the upper run of belt 92.

Roller Control Assembly

In accordance with the present invention, roller control assembly 120 is provided to interact with rollers 72 so as to control the rotation thereof. In the embodiment shown, roller control assembly 120 is comprised of a movable brake device 130 and a stationary brake device 160. Movable brake device 130 is basically comprised of a flexible belt 132. Brake belt 132 is a generally continuous loop that is mounted around a drive sprocket 134 and an idler sprocket 136. Drive sprocket 134 and idler sprocket 136 include teeth that operatively interact with splines formed on brake belt 132. Drive sprocket 134 and idler sprocket 136 are mounted on the distal ends of an elongated beam 138 (best seen in FIG. 3). Drive sprocket 134 is mounted onto a drive shaft 142 that extends from a drive motor 144. Drive motor 144 is mounted on side plate 44 and is operable to controllably drive belt 132 about a path that is generally parallel to the path of conveyor belt 92. In the embodiment shown, beam 138 and belt 132 are mounted to pivot about drive shaft 142. An actuator 152 is fixedly mounted to frame assembly 40 to reciprocally move the end of beam 138. In the embodiment shown, actuator 152 is a cylinder (either pneumatic or hydraulic) that is attached at one end to beam 138 and at the other to frame assembly 40. Actuation of the cylinder is operable to move brake belt 132 between a first position shown in FIG. 1 wherein brake belt 132 is in contact with the surface of rollers 72, and a second position wherein brake belt 132 is away from, and not in contact, with rollers 72. As best seen in FIG. 2, brake belt 132 is disposed near side wall 44 and engages only one end of rollers 72, thereby leaving the space above the center portions of rollers 72 unobstructed.

Referring now to FIGS. 1 and 3, stationary brake device 160 is best seen. Stationary brake device 160 is generally comprised of an elongated rail 162 that extends along a major portion of the lower run. As best seen in FIG. 3, rail 162 has an L-shaped cross-section and is mounted to side plate 44 by conventional fasteners 68. A brake pad 164 formed of a tough, frictional material is disposed on the bottom surface of rail 162. Brake pad 164 is disposed to engage the upper surface of rollers 72 as they move along the lower path run. To this end, the leading edge 168 of rail 162 is contoured to engage rollers 72 as they move around idler sprocket 98. In the embodiment shown, rail 162 is slightly concave to match the convex surface of lower track 66.

Stacking Assembly

Stacking assembly 180, best seen in FIG. 1, is generally comprised of a stacking platform 182 supported by a movable support. In the embodiment shown, stacking platform 182 is supported on a rod 184 that extends from a base 186. Stacking platform 182 is preferably operable to move downward a predetermined distance each time a sheet S is stacked thereon. In this respect, stacking platform 182 may be supported by a compression spring (not shown), wherein stacking platform will lower as the weight thereon increases. Alternately, rod 184 and base 186 may be comprised of a conventional hydraulic or pneumatic cylinder, or a mechanical screw device, that is operably controlled to lower stacking platform 182 after a predetermined number of sheets S have been stacked thereon. As shown in FIG. 1, stacking platform 182 is disposed at one end of sheet stacking device 10 and is generally centrally located between side plates 42, 44 below rollers 72.

Operation

Referring now to FIGS. 4A through 4M, the operation of sheet stacking device 10 shall be described. In FIGS. 4A through 4M, the components of stacking device 10 have been in some cases simplified and enlarged for the purposes of illustration and easier identification. In this respect, the relative size of rollers 72 and movable brake device 130 have been enlarged for easier identification. Further, to reduce the complexity of the drawings, the slightly convex shape of upper tracks 64 and 65 and lower tracks 66 and 67 are not shown. (As indicated above, the upper surface of tracks 64, 65, 66 and 67 may be flat without deviating from the present invention). In addition, for a clearer visual illustration, movable brake device 130 is shown as being movable in its entirety relative to roller bed 110 rather than being pivotable about drive shaft 142, as in FIGS. 1–3. It will be appreciated by those skilled in the art that the simplification of the drawings shown in FIGS. 4A–4M are for the purposes of illustration only, and are not intended to suggest a structural change in the device heretofore described.

Figure 4A:
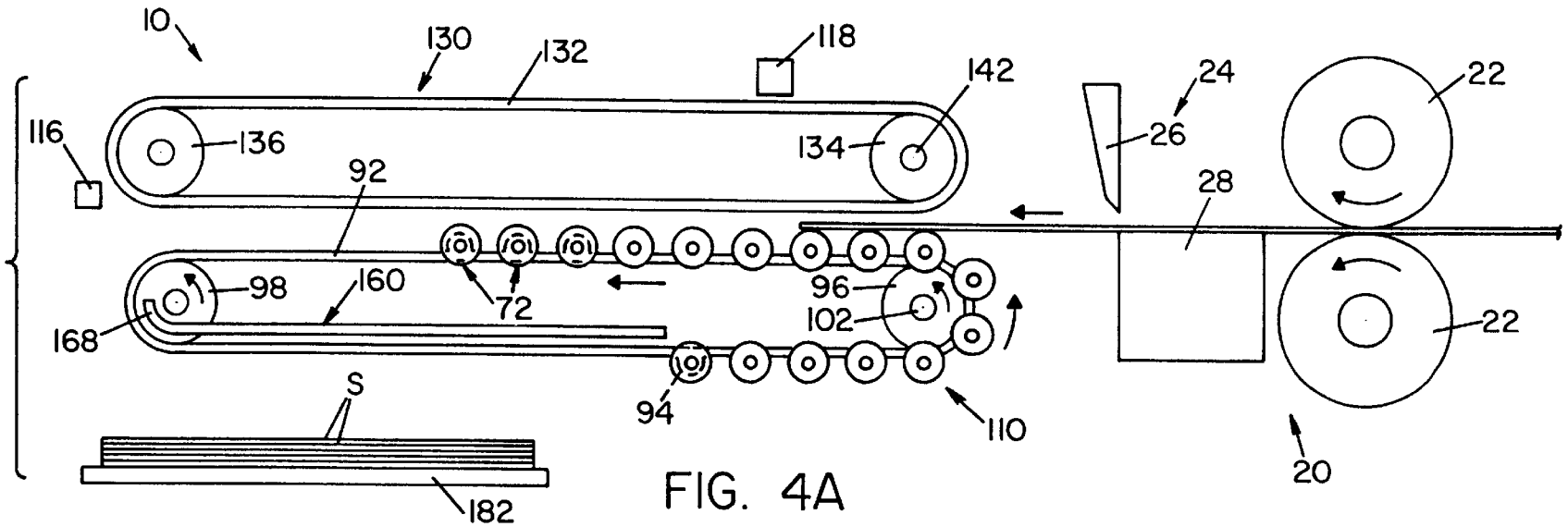
FIGS. 4A–4M are schematic side elevational views of the sheet stacking device shown in FIG. 1, illustrating a sequence involved in stacking a sheet.

Referring now to FIG. 4A, roller bed 110 is shown in a preferred first position to receive a sheet S from sheet cutting device 20. In its initial operating position, movable brake device 130 is in its second position, wherein belt 132 is not in contact with rollers 72. In the embodiment shown, a section of the generally continuous sheet material is fed onto the upper surface of rollers 72 by drive rollers 22. Since belt 132 does not engage rollers 72, rollers 72 are free to rotate about their respective axes. As the sheet material is being fed onto roller bed 110, drive motor 104 causes drive sprocket 96 to rotate and move belt 92 in the direction shown. Since rollers 72 are free-wheeling, roller bed 110 may move to a predetermined position without exerting any influence on the sheet material.

Figure 4B:
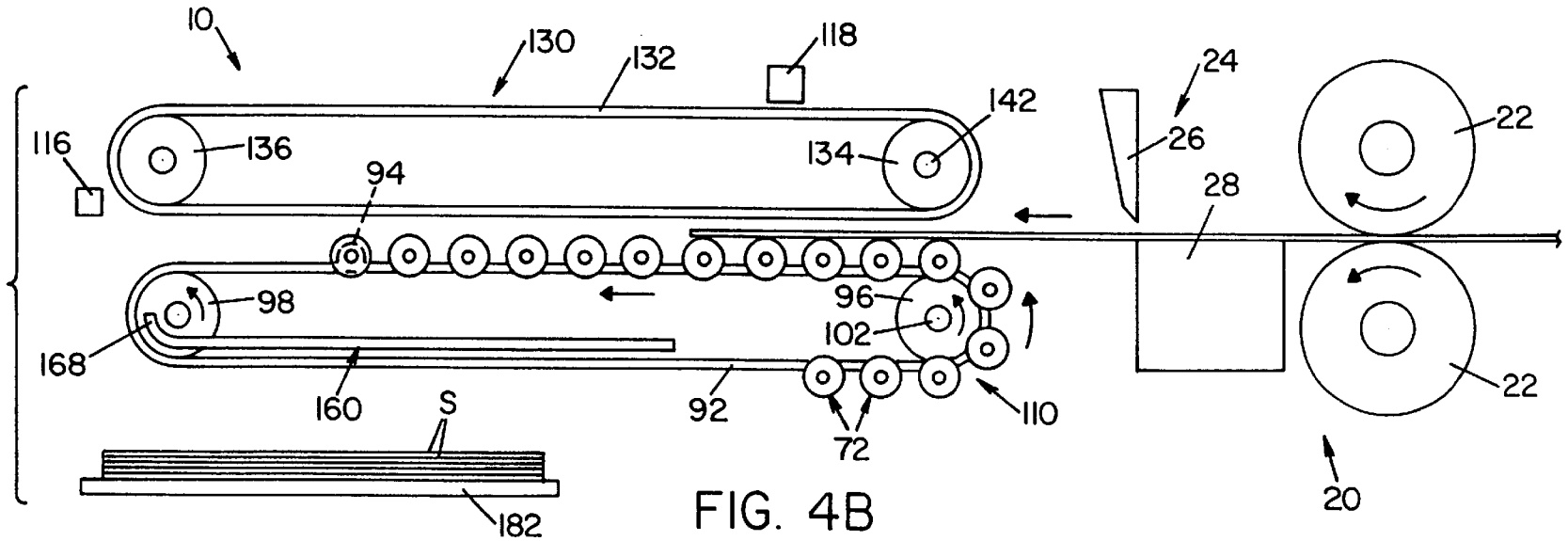
Figure 4C:
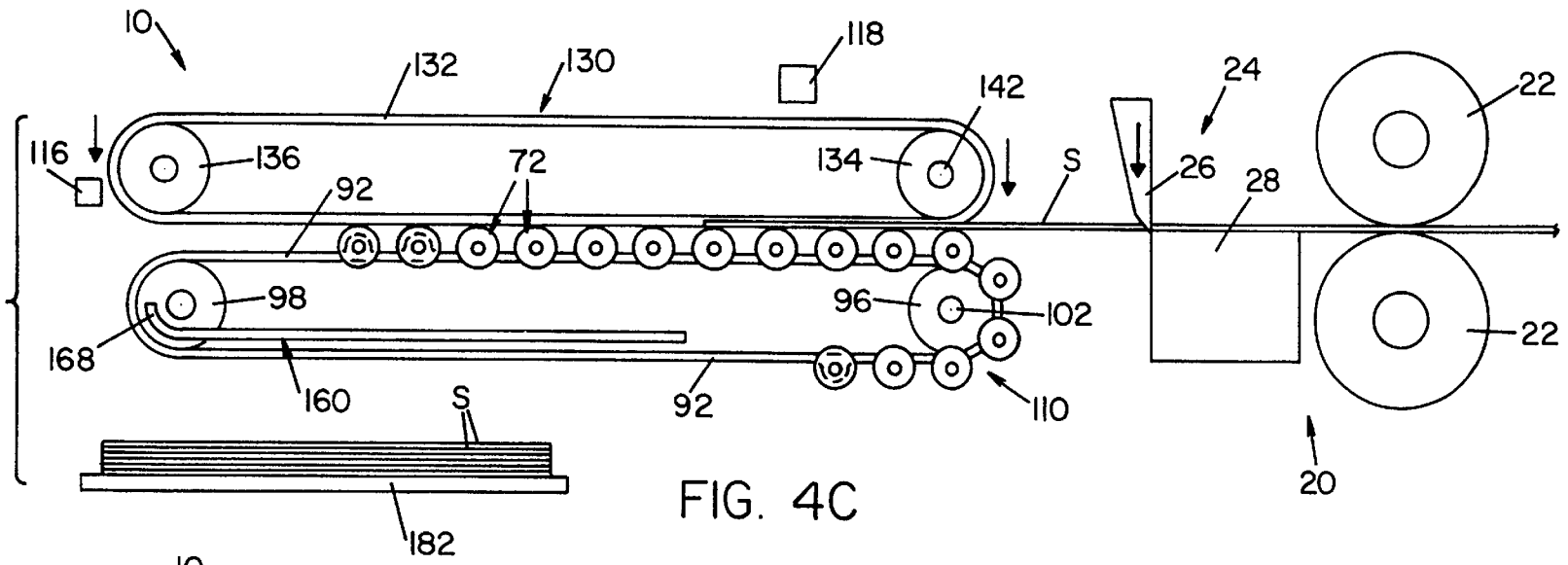

FIG. 4B shows roller bed 110 of stacking device 10 continuing to move in a counter-clockwise direction as the sheet material is being fed onto roller bed 110. When a predetermined length of the sheet material has been fed onto roller bed 110 by drive rollers 22, movement of roller bed 110 ceases at a predetermined location. When in the predetermined position, upper die 26 from cutting device 24 moves downward to shear sheets S from the generally continuous length of sheet material. At approximately the same time, movable brake 130 moves downward such that belt 132 engages the upper surface of rollers 72. Importantly, as indicated above, belt 132 of movable brake 130 engages only one end of rollers 72 and does not come in contact with the sheet material resting thereon.

Figure 4D:
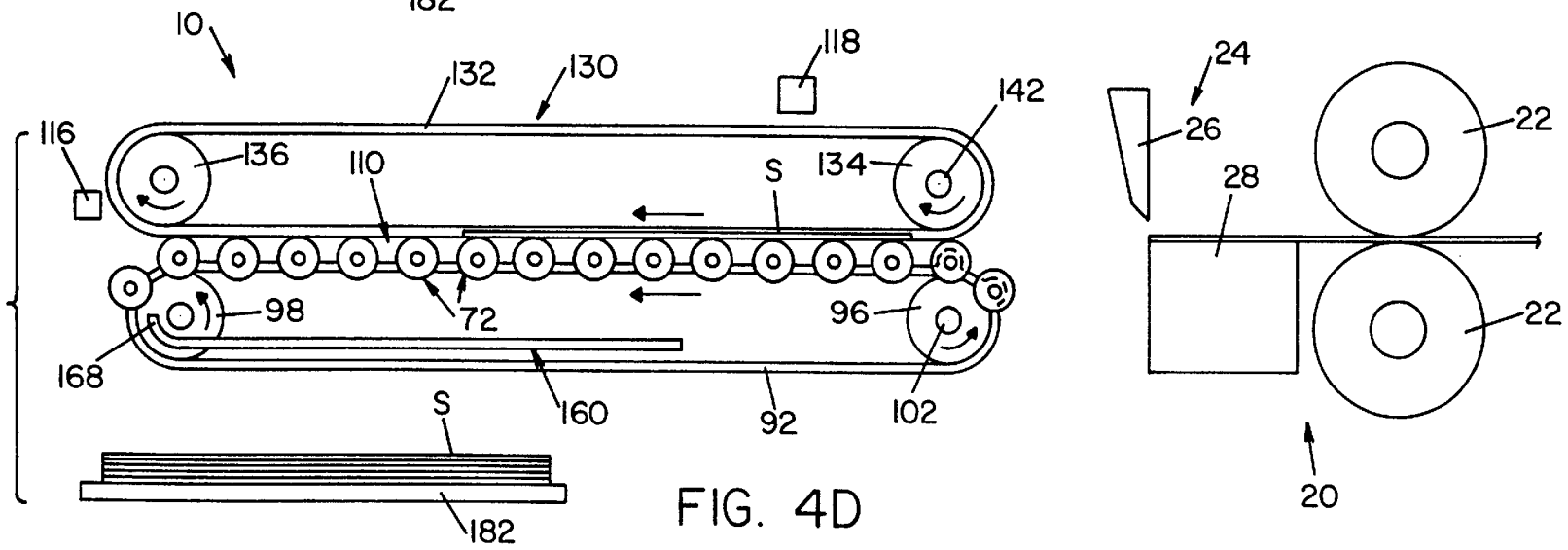
Figure 4E:
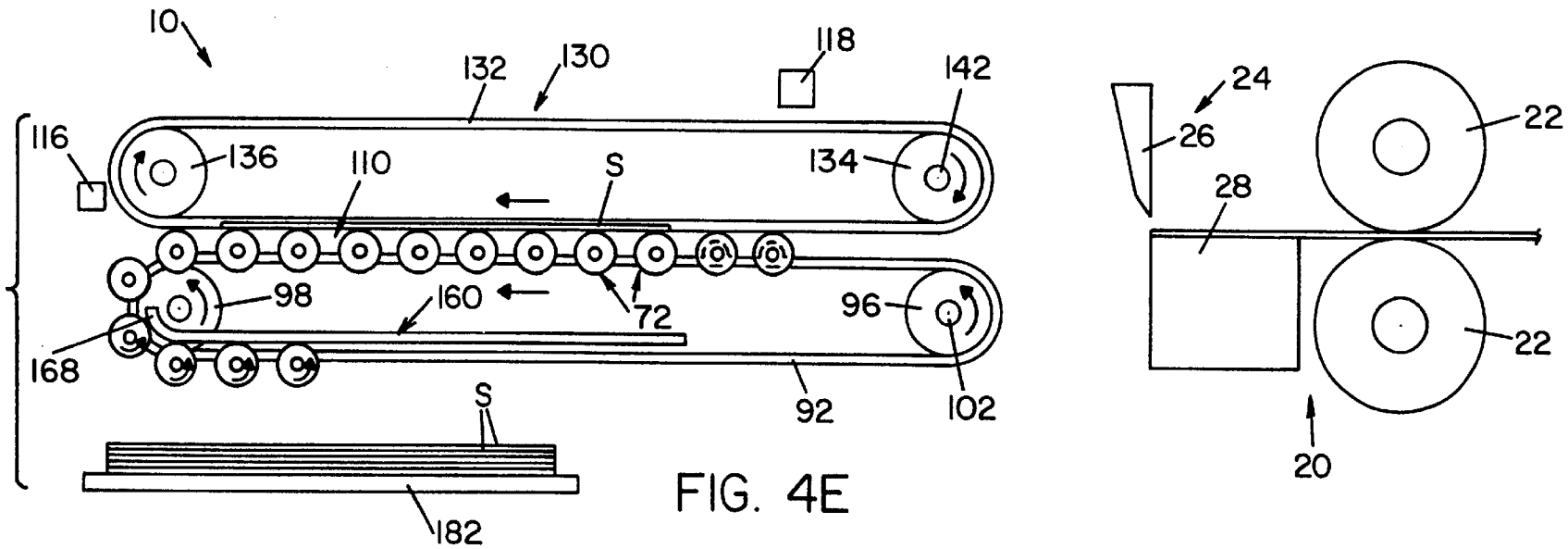
Figure 4F:
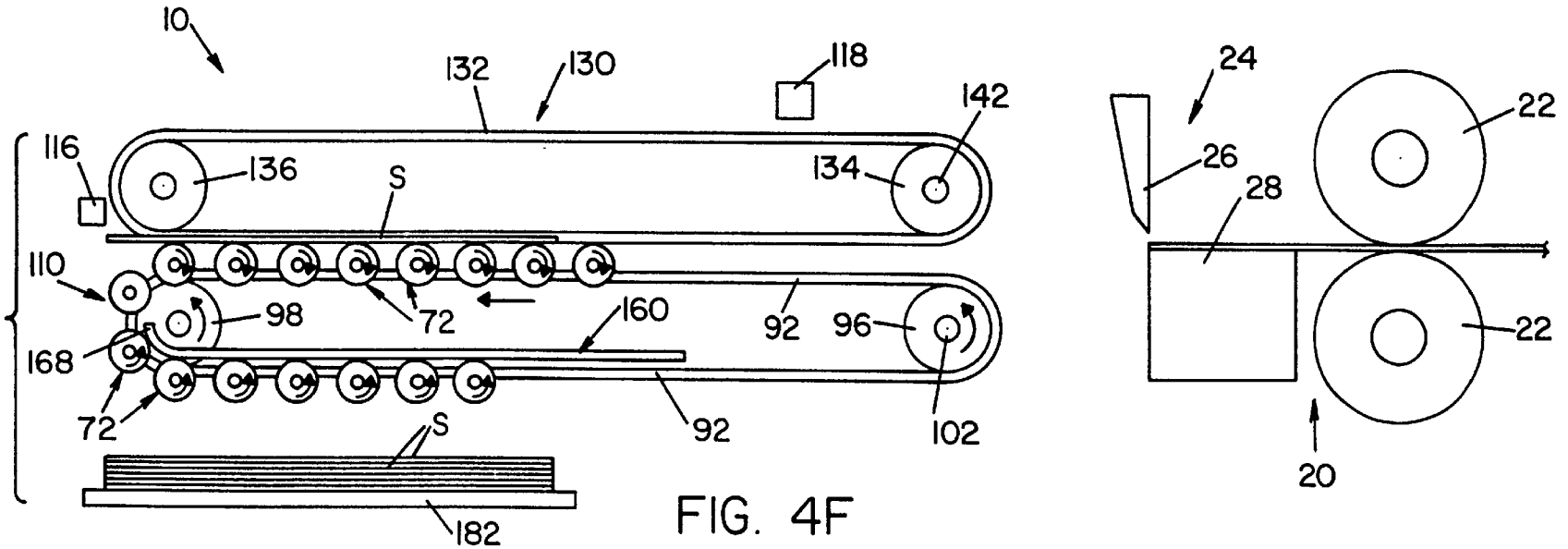

With a sheet S resting upon the surface of rollers 72, drive motor 104 is energized to cause roller bed 110 to move in a counter-clockwise direction along the upper path. At the same time, motor 144 of movable brake device 130, causes belt 132 to move in a clockwise direction as shown in FIG. 4D. In accordance with the present invention, conveyor belt 92 and control belt 132 are timed to move at the same speed. As a result of the motion of both belts at the same speed, rollers 72 move along the upper run in a "locked" position. In other words, each roller maintains a stationary position relative to its respective roller axis. As a result, sheet S moves along the upper run toward sensor 116 as best seen in FIGS. 4D and 4E. As shown in FIG. 4E, as rollers 72 move around idler sprocket 98, onto the lower run, each individual roller moves away from engagement with belt 132 and comes into contact with stationary brake device 160. As the surface of rollers 72 come into contact with brake pad 164, (as illustrated in FIG. 3), rollers 72 begin to rotate in a counter-clockwise direction about their respective axes as illustrated in FIG. 4E. As roller bed 110 continues to move around idler sprocket 98 from the upper run to the lower run, sheet S is carried to a predetermined position relative to sensor 116. When sheet S reaches a predetermined position relative to sensor 116, a signal generated by sensor 116 causes the controller (not shown) to deactivate motor 144 of movable brake device 130 thereby stopping the motion of belt 132. With belt 132 still engaging rollers 72 of roller bed 110 that remain on the upper run, but with belt 132 now being stationary, the rollers that still engage belt 132 begin to rotate in a clockwise direction as illustrated in FIG. 4F. As roller bed 110 continues to move from the upper run to the lower run, the clockwise rotation of rollers 72 still in contact with belt 132, basically maintain sheet S in a stationary position relative to stacking device 10. In this respect, the clockwise rotation of rollers 72 on the upper run influence the sheet S in a direction to the right as shown in the drawings. However, the motion of roller bed 110 to the left effectively cancels the motion imparted by the rotation of rollers 72 and causes sheet S to basically remain stationary in its stacking position.

Figure 4G:
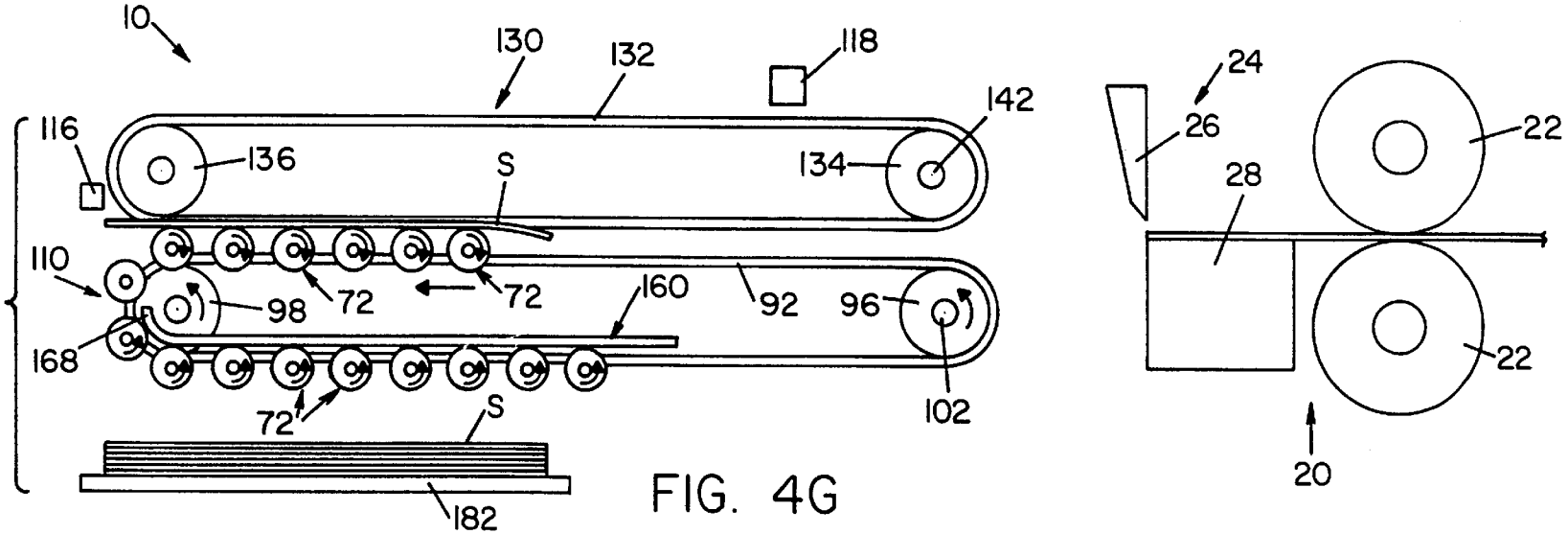
Figure 4H:
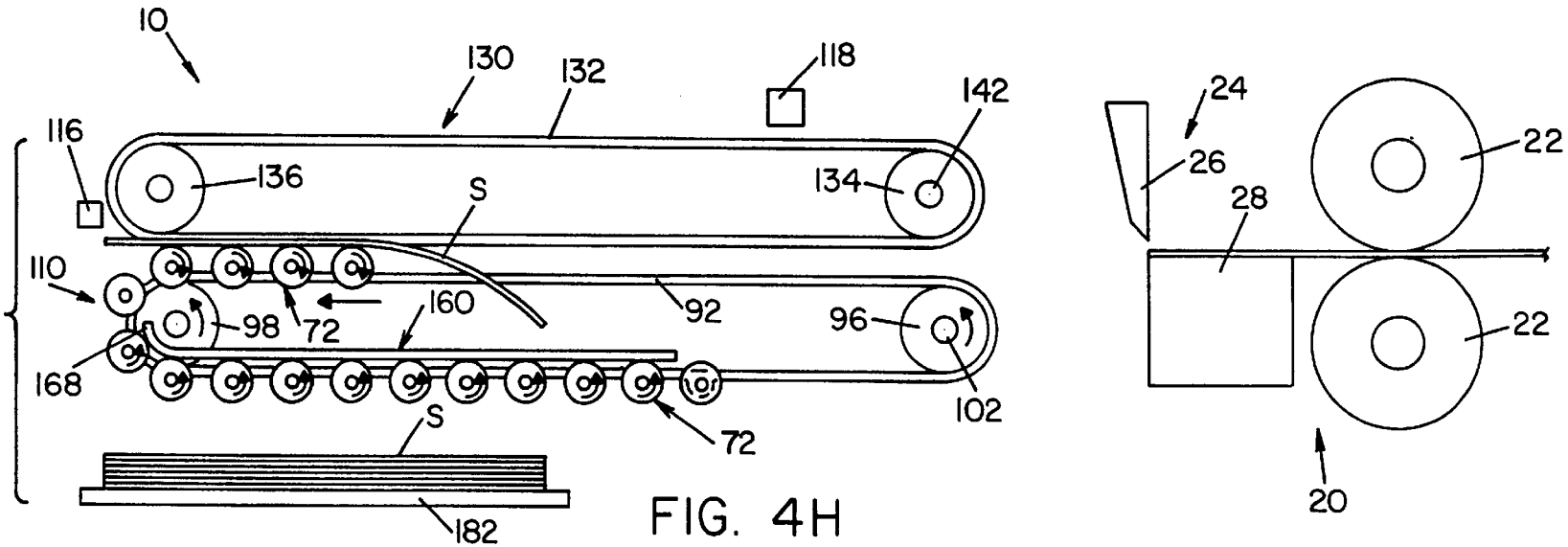
Figure 4I:
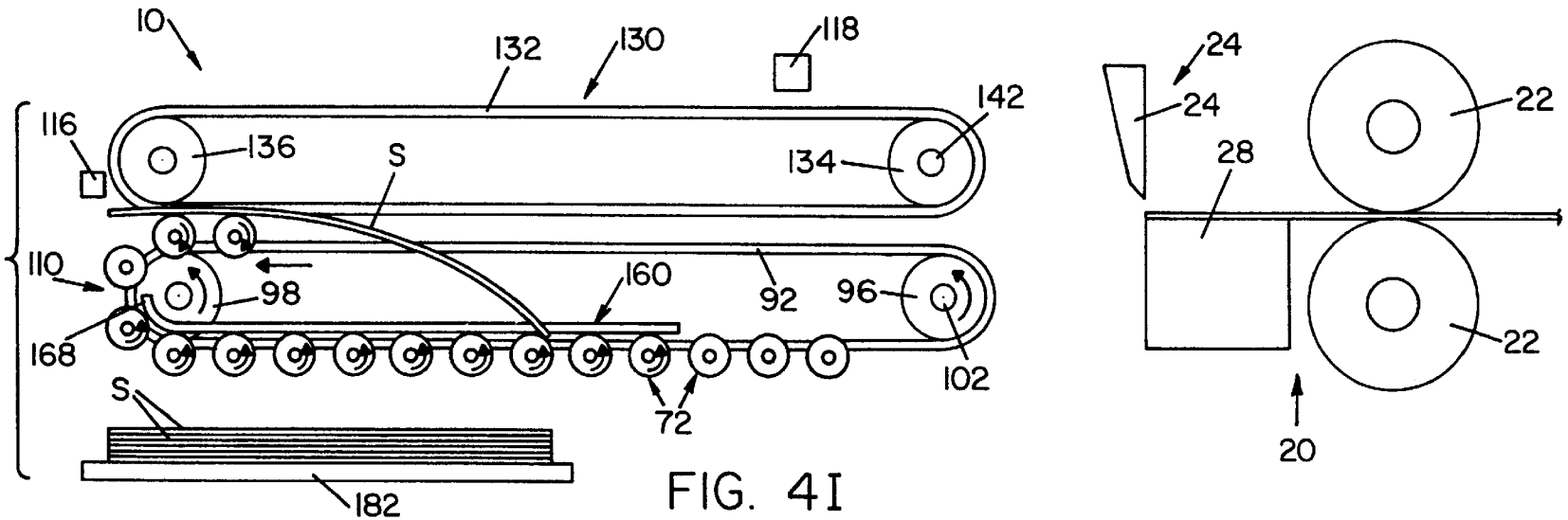
Figure 4J:
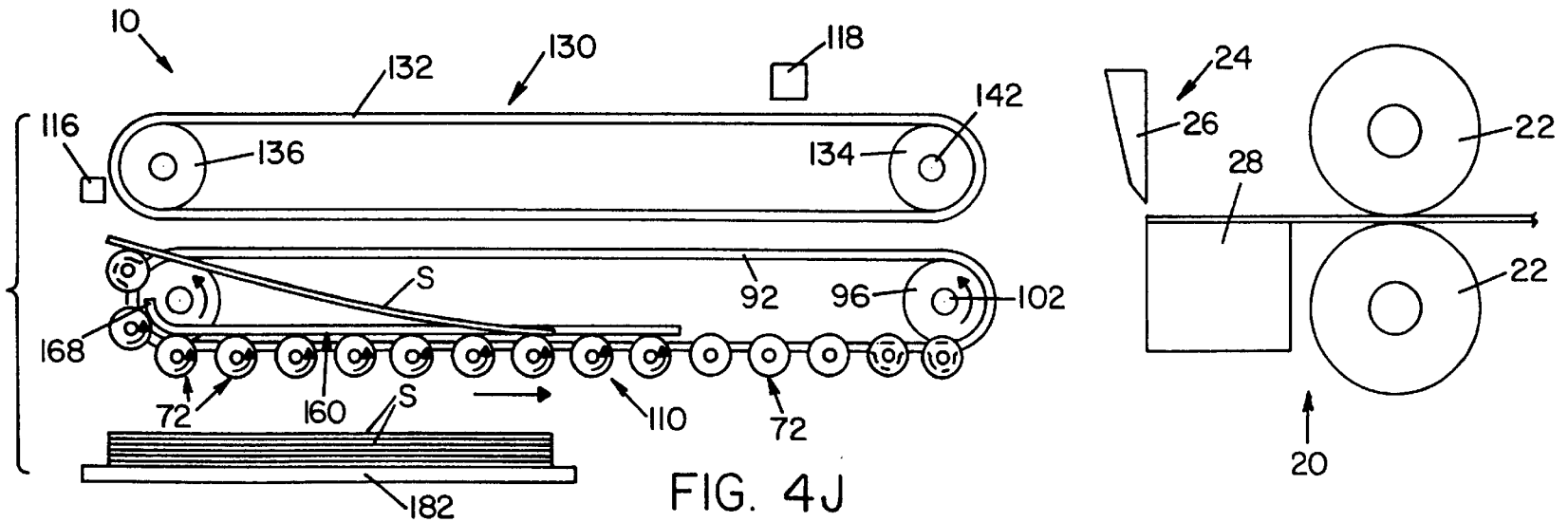
Figure 4K:
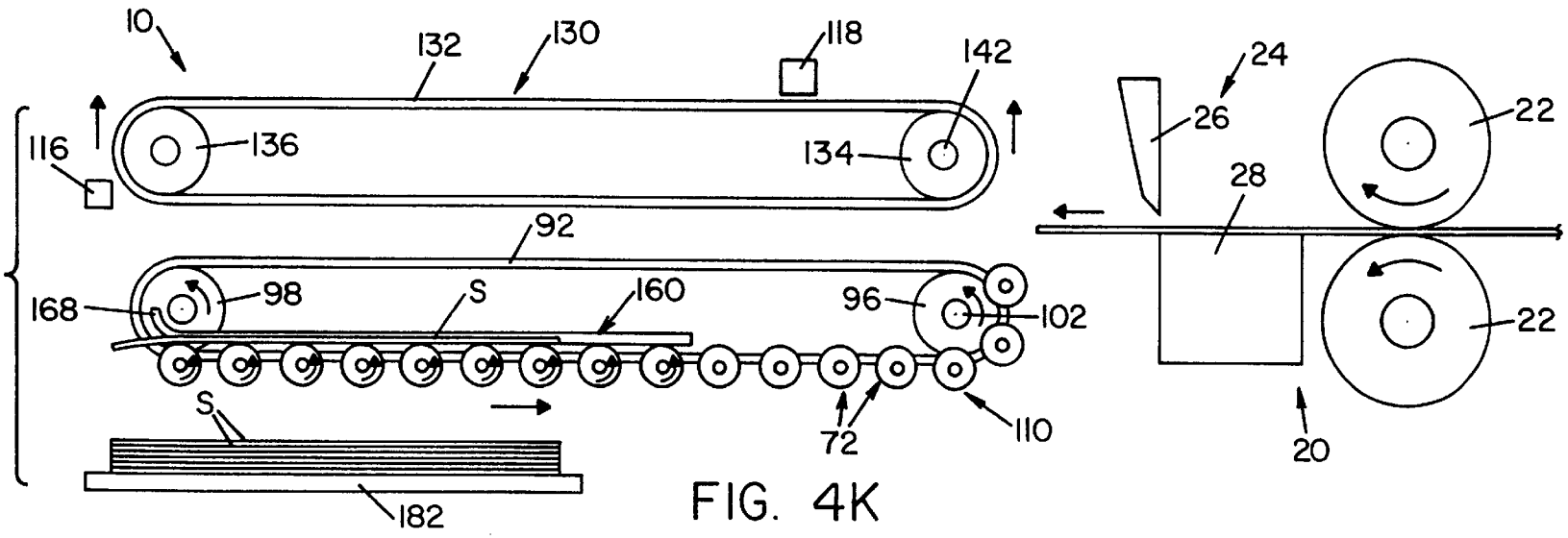

As roller bed 110 continues to move from the upper run to the lower run, support for sheet S will begin to disappear as rollers 72 move from under sheet S as illustrated in FIGS. 4G and 4H. As support for sheet S on the upper run disappears, sheet S drops down onto the lower run where it comes in contact again with the upper surfaces of rollers 72. Because of the counter-clockwise rotation of rollers 72 along the lower run (imparted by stationary brake device 160), sheet S effectively remains stationary relative to the moving roller bed 110 as illustrated in FIGS. 4J and 4K. Eventually, as all of the rollers 72 forming roller bed 110 move from the upper run to the lower run, sheet S falls completely onto the lower run as shown in FIG. 4K. The counter-clockwise rotation of rollers 72 along the lower run effectively maintain sheet S stationary as roller bed 110 continues to move in a counter-clockwise direction along the lower run and back up onto the upper run. The counter-clockwise rotation of rollers 72 along the lower run maintains the sheet S in a position above stacking platform 182. As the rollers 72 move from under sheet S, sheet S drops onto stacking platform 182.

Figure 4L:
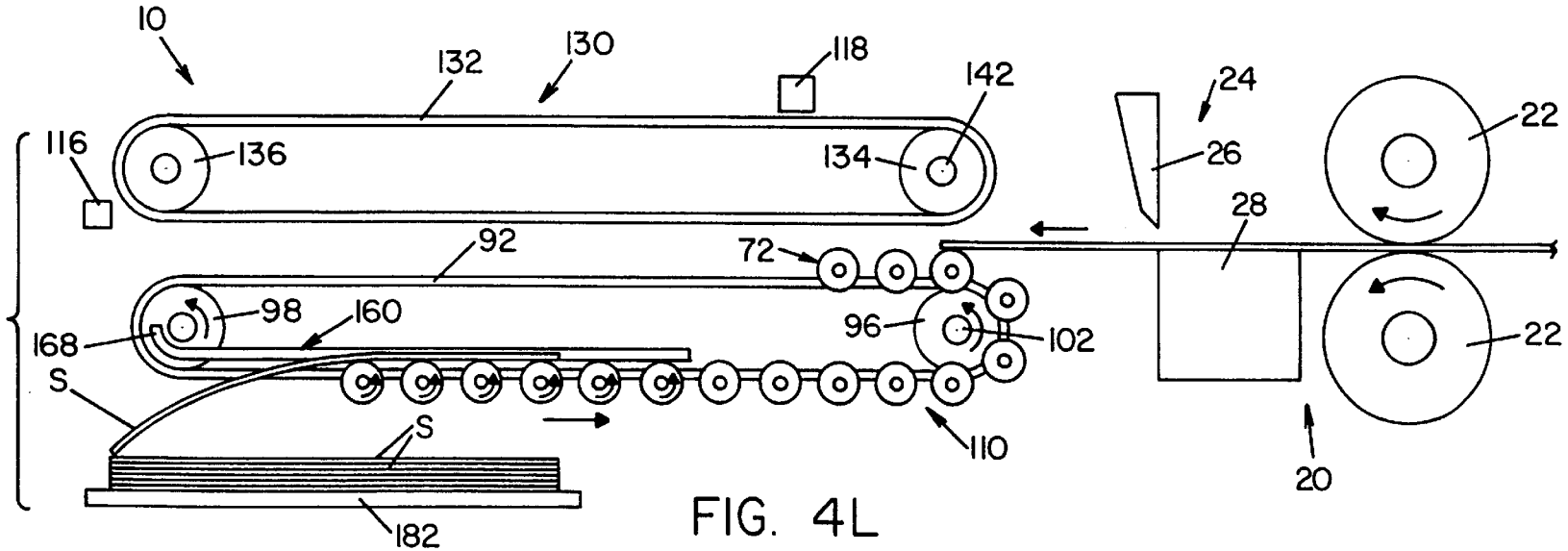
Figure 4M:
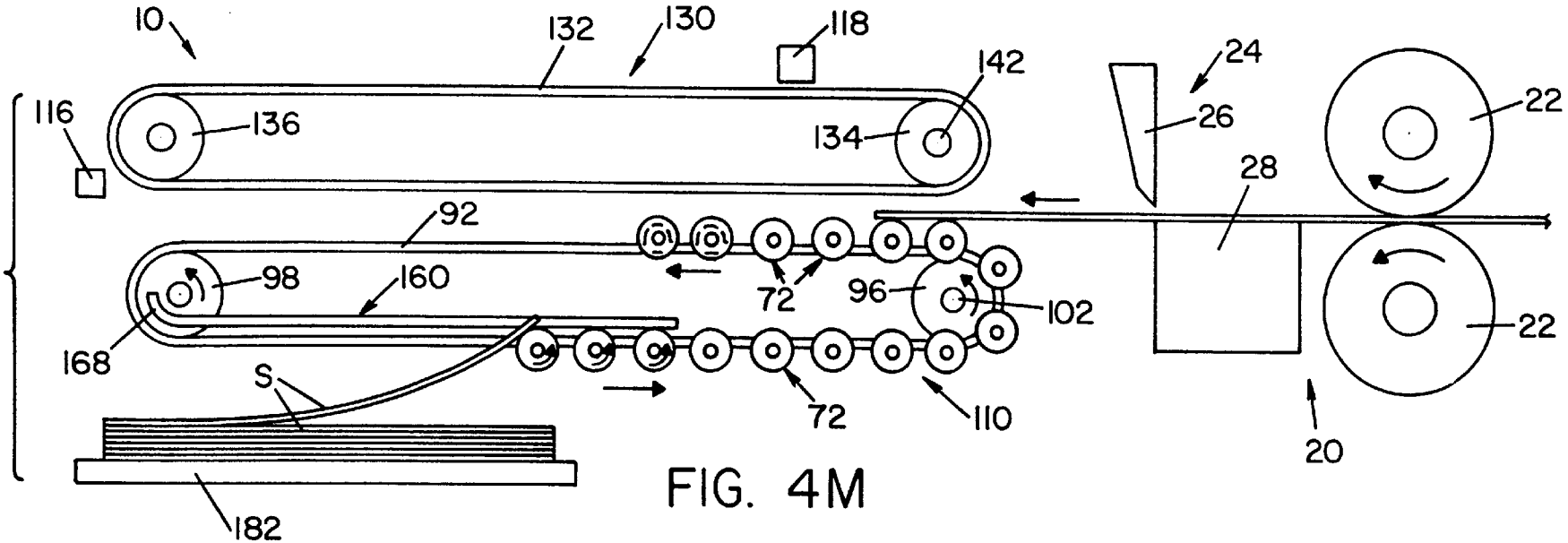

As shown in FIGS. 4K, 4L and 4M, stacking device 10 is preferably timed such that as one sheet S is dropping onto stacking platform 182, roller bed 110 is returning to its initial starting position and another length of the sheet material is being driven onto rollers 72 on the upper run by drive rollers 22.

The present invention thus provides a sheet stacking device that conveys a sheet material to a first position along an upper run and thereafter maintains the sheet in this relative vertical position by controlling the direction of rotation of the individual rollers 72 as the roller bed 110 moves along a closed path. As a result of the rotation of the rollers, the sheet basically drops from the upper run onto the lower run as roller bed 110 moves from the upper run to the lower run. Thereafter, sheet S is dropped onto a stacking platform 182 as the rollers along the lower run move from under sheet S. Importantly, sheet S is not pinched or squeezed between two surfaces, but merely rests upon the upper surfaces of rollers 72 and is conveyed by the rotation of such rollers from the upper run to the lower run to the stacking platform. Thus, minimal contact is exerted on sheet S as it is stacked.

Figure 5A:
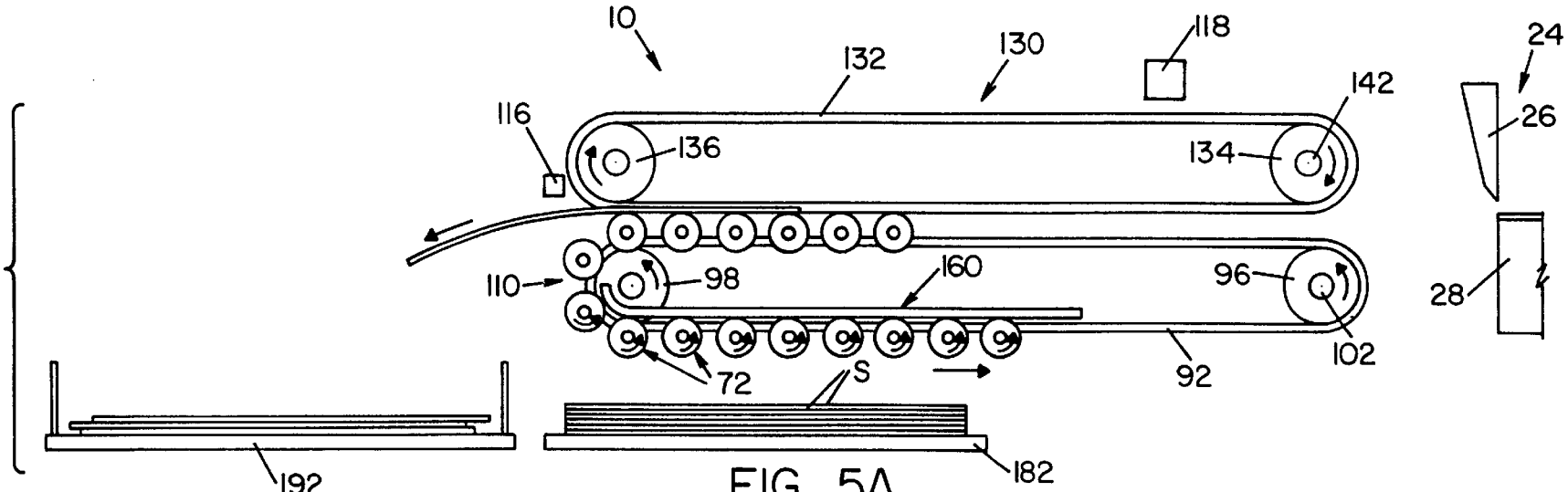
FIGS. 5A and 5B are schematic side elevational views of the sheet stacking device shown in FIG. 1, illustrating a sequence for diverting a defective sheet from the stacking process.
Figure 5B:
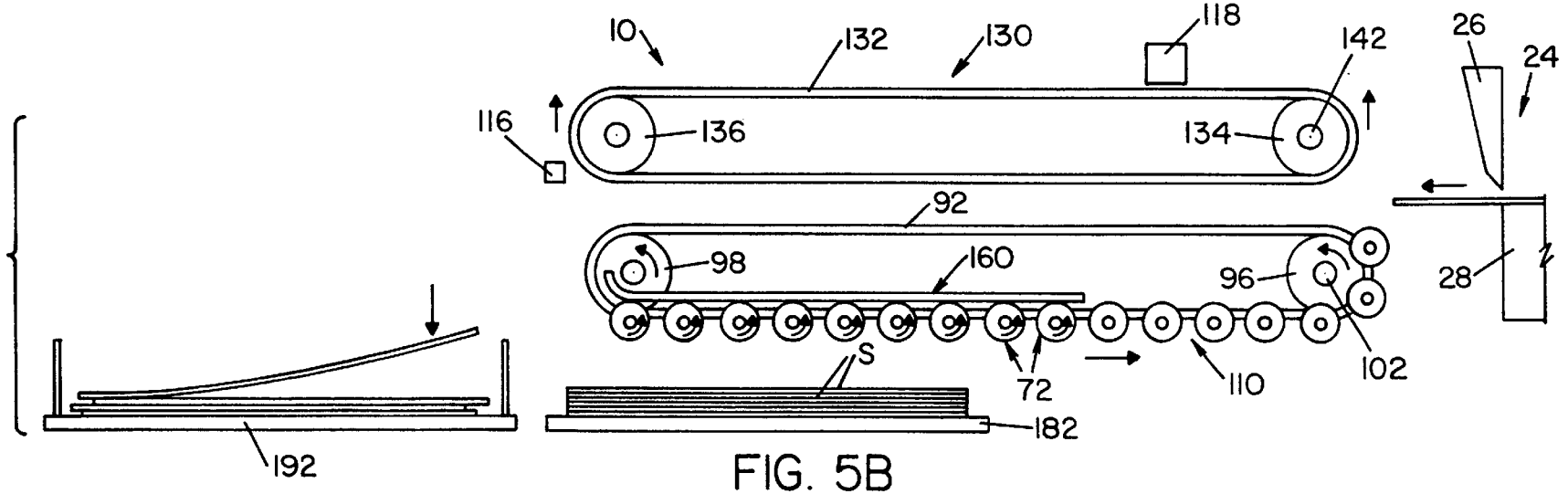

Referring now to FIGS. 5A and 5B, another aspect of the present invention is illustrated. In accordance with this aspect of the present invention, the upper surface of each sheet S is scanned for defects or imperfections by scanner 118 as it moves along the upper run of belt 92. If a defect or flaw is detected in the surface of a sheet S, such sheet S is diverted from the stacking operation. The defective sheet is diverted from the stacking process by conveying it off the upper run into a scrap bin 192. The defective sheet S is conveyed off of roller bed 110 by continuing to drive belt 132 when the defective sheet S reaches the sheet stacking position (shown in FIG. 4F). If drive belt 132 continues to move with roller bed 110, the defective sheet S will be conveyed off of the end of sheet stacking device 10 into scrap bin 192, as schematically illustrated in FIGS. 5A and 5B. Thus, once a defective sheet S is sensed by scanner 118, the control unit that controls the operation of sheet stacking device 10, can control motor 144 of movable brake device 130 to cause belt 132 to continue its clockwise rotation beyond the sheet stacking position. This prevents rotation of rollers 72 and causes the defective sheet to be conveyed into scrap bin 192. Roller bed 110 would then continue back to its initial sheet-receiving position to receive the next sheet S for stacking from sheet cutter 20, as illustrated in FIG. 5B.

It will, of course, be appreciated that scanner 118 need not be located directly above the upper run of conveyor belt 92 or even be part of sheet stacking device 10. The means for scanning and detecting defects may be part of sheet cutter 20 or be located before sheet cutter 20.

Figure 6:
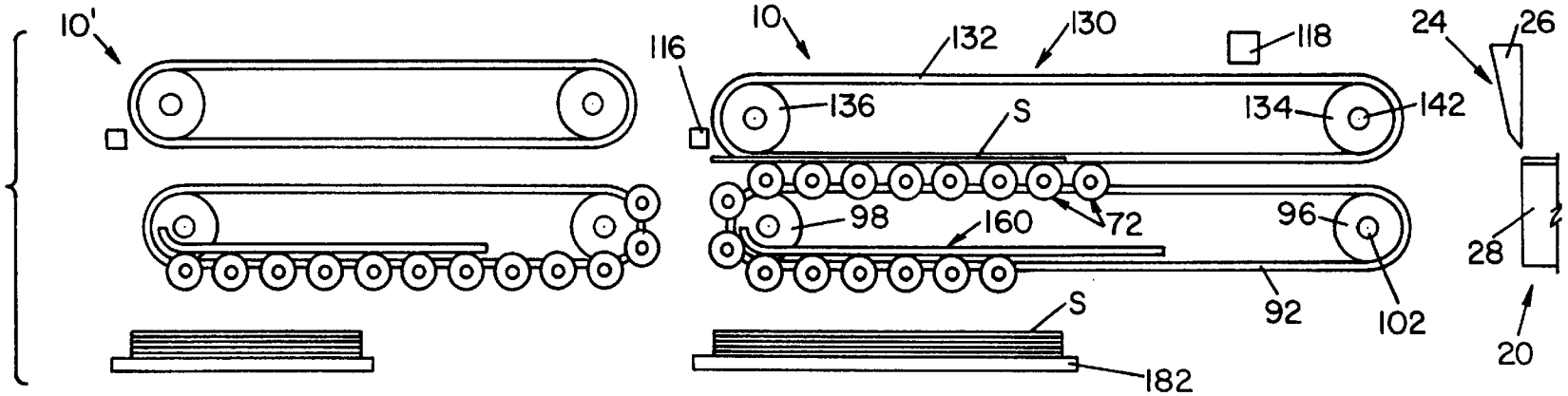
FIG. 6 is a schematic view showing two stacking devices in alignment for stacking sheets of different size or for sequentially stacking of sheets of the same size.

Referring now to FIG. 6, a pair of stacking devices designated 10 and 10', illustrate another embodiment of the present invention. Sheet stacking device 10 is the same device as heretofore described. Sheet stacking device 10' may be the same (not shown) as sheet stacking device 10, or may be a shorter version of stacking device 10 adapted to stack sheets of a different size, as illustrated in FIG. 6.

By providing two identical stacking devices 10 in a row, one device 10 could be stacking sheets S while a stack of sheets S is being removed from the other. This enables continuous cutting and stacking of sheets S without the down time to remove a stack of sheets from platform 182.

Alternatively, sheet stacking device 10' may be adapted to stack different size sheets than stacking device 10, as shown in FIG. 6. In this respect, the size of rollers 72 and roller bed 110 may be modified and/or the timing of the operation of stacking device 10' may be adjusted to stack sheets of a different size. Such a dual stacking arrangement allows cutting device 20 to be used to cut sheets S of more than one size.

In both of the foregoing configurations, sheets S to be stacked on stacking device 10' would be conveyed across stacking device 10 by controlling the operation of belt 132 of movable brake device 130, in a manner as previously described.

A device 10 in accordance with the present invention, lends itself to numerous modifications and arrangements for stacking a wide variety of sheet material in a number of different ways.

Figure 7:
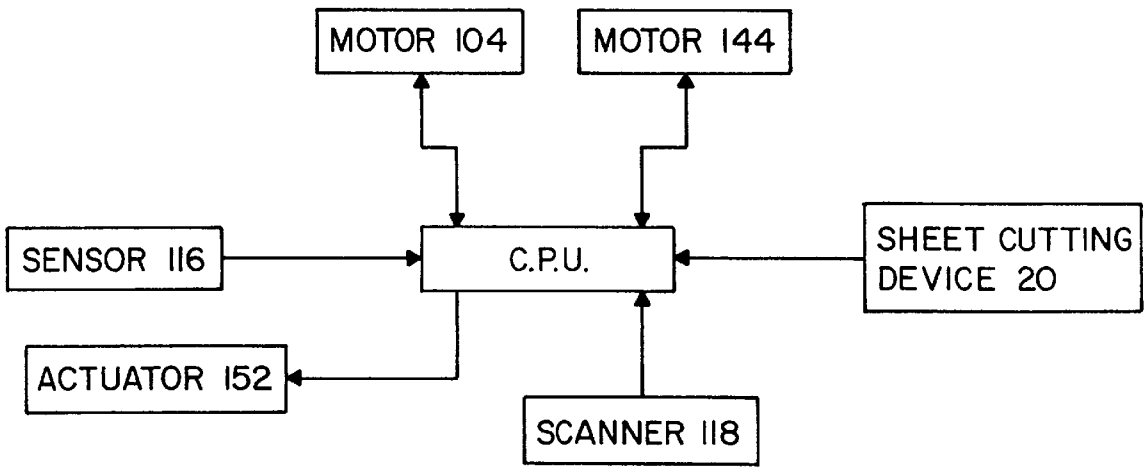
FIG. 7 is a schematic control diagram showing a control system for the stacking device shown in FIG. 1.

FIG. 7 is a schematic block diagram of a control system for controlling a stacking device 10, as heretofore described. As illustrated, a central processor controls the operation of motors 104, 144 and actuator 152 based on feedback from motors 104, 144 (preferably stepper motors) and data received from sensor 116, scanner 118 and sheet cutting device 20.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A sheet stacking device, comprised of:

a sheet support bed comprised of a plurality of side-by-side rollers, each of said rollers being freely rotatable about a respective roller axis;

a support bed drive assembly for moving said sheet support bed in a predetermined direction along a closed path, said path having an upper horizontal run and a lower horizontal run and being dimensioned such that a gap exists between a leading end and a trailing end of said sheet support bed, said gap moving along said path as said sheet support bed moves along said path;

a roller control assembly for selectively controlling rotation of each of said rollers about its respective roller axis; and a controller for selectively and sequentially controlling the operation of said support bed drive assembly and said roller drive assembly, wherein said stacking device is operable to perform the following operational steps:

a) causing said support bed drive assembly to move said sheet support bed to a sheet receiving position on said upper run of said path;

b) causing said roller control assembly to allow said rollers to rotate freely to receive a sheet to be stacked on said support bed;

c) causing said support bed drive assembly to move said sheet support bed at a predetermined speed along said path to move said sheet to a "stacking position";

d) when said sheet is at said stacking position, causing said roller control assembly to rotate said roller in a predetermined direction at a predetermined speed while said support bed continues to move along said path, wherein said rollers are operable to convey said sheet in a direction opposite the direction of said support bed at a speed wherein said sheet remains essentially stationary at said "stacking position";

e) continuously driving said sheet support bed along said path and continuously rotating said roller wherein said sheet becomes unsupported as said trailing end of said sheet support bed passes under said sheet and said sheet drops through said gap onto said sheet support bed as it moves along said lower run;

f) causing said rollers along said lower run to rotate at a predetermined speed in a predetermined direction wherein said sheet is conveyed in a direction opposite said direction of said support bed at a speed wherein said sheet remains essentially stationary at a position essentially below said stacking position; and g) continuously driving said sheet support bed along said path and continuously rotating said roller along said lower run wherein said sheet becomes unsupported as said trailing end of said sheet support bed passes under said sheet and said sheet drops through said gap onto a stacking platform.

2. A device as defined in claim 1, wherein said roller control assembly is comprised of an upper run roller drive element and a lower run roller drive element.

3. A device as defined in claim 2, wherein said upper run roller drive element has a first position wherein said upper run roller drive element is disengaged from said rollers and a second position wherein said upper run roller drive element engages said rollers along said upper run, said upper run roller drive element having a first operating condition wherein said rollers move along said path without rotating about their respective axes and a second operating condition wherein said upper run roller drive element causes said roller along said upper run to rotate in a predetermined direction at a predetermined speed that is operable to convey said sheet in a direction opposite to the direction of travel of said sheet support bed along said path.

4. A device as defined in claim 3, wherein said upper run roller drive element is a friction belt disposed generally parallel to said upper run.

5. A device as defined in claim 4, wherein when said friction belt in said first operating condition engages said rollers and moves with said rollers at a speed equal to the speed of said sheet support bed in a direction that is the same as the direction of said sheet support bed along said path, and in said second operating condition engages said rollers and is stationary.

6. A device as defined in claim 5, wherein said friction belt engages said rollers at the longitudinal ends thereof.

7. A device as defined in claim 6, wherein said lower run roller drive element is a stationary surface disposed along said lower run engaging said rollers to cause said rollers moving along said lower run to rotate in a direction wherein a sheet on said rollers on said lower run is conveyed in a direction opposite the direction of said rollers moving along said lower run.

8. A sheet stacking device, comprised of:

a sheet support bed having a first end and a second end, said sheet support bed comprised of a plurality of side-by-side rollers, each of said rollers being freely rotatable about an associated roller axis;

a drive assembly for moving said sheet support bed in a predetermined direction along a closed path, said path having a horizontal upper run and a horizontal lower run and being dimensioned such that a space exists between said first end and said second end of said sheet support bed as said sheet support bed moves along said path; and a roller control assembly for selectively and sequentially controlling rotation of select ones of said rollers at select intervals during a stacking operation, wherein said stacking device is operable to:

receive a sheet to be stacked on said sheet support bed when said support bed is disposed along said upper run;

convey said sheet along said upper run on said support bed to a "staking position" on said upper run;

cause said roller control assembly to rotate rollers disposed along said upper run in a direction such that said sheet remains essentially in said stacking position as said sheet support bed continues to move along said path, said sheet dropping through said space between said first and said second end of said sheet support bed onto said rollers of said sheet support bed on said lower run when said support bed moves from said upper run to said lower run; and cause said roller control assembly to rotate rollers disposed along said lower run in a direction such that said sheet remains essentially in said stacking position as said sheet support bed continues to move along said path, said sheet dropping through said space between said first end and said second end of said sheet support bed onto a stack of sheets when said support bed moves from said lower run to said upper run.

9. A device as defined in claim 8, wherein said roller control assembly includes a frictional surface engageable with said rollers that move along said upper run, said frictional surface movable between a first position wherein said frictional surface is not in engagement with said roller and a second position wherein said frictional surface is in engagement with said rollers.

10. A device as defined in claim 9, wherein said frictional surface is movable with said roller along said upper run.

11. A device as defined in claim 10, wherein said frictional surface is an endless flexible belt that is movable along a path having a portion that extends generally parallel to said upper run.

12. A device as defined in claim 11, further comprising a controllable drive motor for conveying said belt along said path.

13. A device as defined in claim 12, wherein said flexible belt is disposed along one end of said rollers.

14. A device as defined in claim 10, wherein said roller control assembly includes a lower frictional surface engageable with said rollers that move along said lower run, said lower friction surface operable to rotate said roller as said roller moves along said lower path.

15. A device as defined in claim 8, further comprising a controller for controlling the timing and operation of said drive assembly and said roller control assembly.

16. A device as defined in claim 15, further comprising a scanning device for detecting defects or imperfections on a sheet to be stacked, said scanning device providing data to said controller when a defective sheet is scanned.

17. A device as defined in claim 16, wherein said controller upon receiving data from said scanning device indicating a defective sheet modifies the operation of said roller control assembly to convey said sheet along said upper run on said support bed to be conveyed past said stacking position and off said device.

18. A sheet stacking device, comprised of:

a sheet support bed having a first end and a second end, said sheet support bed comprised of a plurality of side-by-side rollers, each of said rollers being freely rotatable about an associated roller axis;

a drive assembly for moving said sheet support bed in a predetermined direction along a closed path, said path having a horizontal upper run and a horizontal lower run and being dimensioned such that a space exists between said first end and said second end of said sheet support bed as said sheet support bed moves along said path;

a roller control assembly for selectively and sequentially controlling rotation of select ones of said rollers at select intervals during a stacking operation;

a controller for controlling the operation of said drive assembly and said roller control assembly; and a scanning device for detecting sheets with defects, said stacking device having a first mode of operation, wherein said stacking device is operable to:

receive a sheet to be stacked on said sheet support bed when said support bed is disposed along said upper run;

convey said sheet along said upper run on said support bed to a "staking position" on said upper run;

cause said roller control assembly to rotate rollers disposed along said upper run in a direction such that said sheet remains essentially in said stacking position as said sheet support bed continues to move along said path, said sheet dropping through said space between said first and said second end of said sheet support bed onto said rollers of said sheet support bed on said lower run when said support bed moves from said upper run to said lower run;

cause said roller control assembly to rotate rollers disposed along said lower run in a direction such that said sheet remains essentially in said stacking position as said sheet support bed continues to move along said path, said sheet dropping through said space between said first end and said second end of said sheet support bed onto a stack of sheets when said support bed moves from said lower run to said upper run; and a second mode of operation wherein a sheet identified by said scanning device as having a defect is conveyed past said stacking position and off said upper run.

19. A method of stacking sheet material, comprising the steps of:

a) conveying a sheet to be stacked onto the surface of a sheet support bed, said support bed comprised of a plurality of side-by-side rollers, each of said rollers being rotatable about a respective roller axis, said support bed being movable in a predetermined direction along a closed path having a horizontal upper run and a horizontal lower run, said path dimensioned such that a space exists between distal ends of said support bed, said space moving along said path as said support bed moves along said path;

b) moving said support bed along said path to move said sheet along said upper path run toward a stacking position;

c) causing said rollers along said upper run to rotate when said sheet reaches said stacking position, said rollers rotating in a direction such that said sheet remains essentially stationary on said support bed at said stacking position as said support bed continues to move along said path, said sheet falling generally vertically onto said support bed on said lower run when said space moves under said sheet;

d) causing said rollers along said lower run to rotate in a direction such that said sheet falling on said support bed from said upper run remains essentially stationary on said support as said support bed continues to move along said path, said sheet falling from said lower run of said support bed when said space moves under said sheet; and e) collecting said sheet at a stacking location below said lower run.

* * * * *